US009200487B2

(12) United States Patent
Draper et al.

(10) Patent No.: US 9,200,487 B2
(45) Date of Patent: Dec. 1, 2015

(54) ALIGNMENT OF DOWNHOLE STRINGS

(75) Inventors: Ian Draper, Godalming (GB); John Clark, Aberdeen (GB); David Brands, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 763 days.

(21) Appl. No.: 13/315,063

(22) Filed: Dec. 8, 2011

(65) Prior Publication Data

US 2012/0145380 A1 Jun. 14, 2012

Related U.S. Application Data

(60) Provisional application No. 61/422,396, filed on Dec. 13, 2010.

(51) Int. Cl.

| | |
|---|---|
| ***E21B 17/10*** | (2006.01) |
| ***E21B 17/14*** | (2006.01) |
| ***E21B 17/05*** | (2006.01) |
| ***E21B 23/14*** | (2006.01) |

(52) U.S. Cl.

CPC ..... *E21B 17/05* (2013.01); *E21B 17/1057* (2013.01); *E21B 23/14* (2013.01)

(58) Field of Classification Search

CPC ..... E21B 17/1057; E21B 17/05; E21B 23/14
USPC ..... 166/241.5, 241.6, 255.1, 255.2, 381; 175/325.3

See application file for complete search history.

(56) References Cited

U.S. PATENT DOCUMENTS

| | | | | |
|---|---|---|---|---|
| 4,624,313 | A * | 11/1986 | Coshow | 166/241.5 |
| 4,793,412 | A | 12/1988 | Rivas et al. | |
| 5,040,619 | A * | 8/1991 | Jordan et al. | 175/4.51 |
| 6,209,667 | B1 | 4/2001 | Murray et al. | |
| 6,494,274 | B1 | 12/2002 | Murray et al. | |
| 6,684,965 | B1 | 2/2004 | Bakke | |
| 6,779,598 | B2 | 8/2004 | Hall | |
| 7,395,881 | B2 | 7/2008 | McKay et al. | |
| 7,434,627 | B2 | 10/2008 | Turley et al. | |
| 7,866,384 | B2 | 1/2011 | Hall | |
| 2003/0075321 | A1 * | 4/2003 | Hall | 166/241.1 |
| 2005/0252655 | A1 * | 11/2005 | McKay et al. | 166/241.7 |
| 2008/0164018 | A1 * | 7/2008 | Hall | 166/241.1 |
| 2008/0264639 | A1 * | 10/2008 | Parrott et al. | 166/297 |
| 2009/0003974 | A1 * | 1/2009 | McNay | 414/22.51 |

OTHER PUBLICATIONS

PCT Notification of Transmittal of the International Search Report and the Written Opinion of the International Searching Authority, or the Declaration, dated Jul. 20, 2012; International Application No.: PCT/US2011/064415; International Filing Date: Dec. 12, 2011.

* cited by examiner

*Primary Examiner* — Robert E Fuller
*Assistant Examiner* — David Carroll
(74) *Attorney, Agent, or Firm* — Bracewell & Giuliani LLP

(57) ABSTRACT

A downhole system includes a downhole string insertable within a subterranean wellbore and a roller assembly coupled with the string. The roller assembly includes rollers mounted on lateral sides of the downhole string for reducing the resistance of deploying the string within the wellbore. The string is rotatable about its axis with respect to the roller assembly; bearing surfaces, or low torque surfaces, are included in the roller assembly to further reduce rotational friction so the string precisely positions itself to a designated orientation.

4 Claims, 7 Drawing Sheets

ALIGNMENT OF DOWNHOLE STRINGS

RELATED APPLICATIONS

This application claims priority to and the benefit of co-pending U.S. Provisional Application Ser. No. 61/422,396, filed Dec. 13, 2010, the full disclosure of which is hereby incorporated by reference herein.

BACKGROUND OF THE INVENTION

1. Field of the Invention

The disclosure herein relates generally to the field of subterranean hydrocarbon production. More specifically the present invention relates to a system for facilitating desired orientation of a downhole string.

2. Description of Related Art

Many downhole tools, including perforating guns, comprise multiple elongated bodies joined end to end. If the elongated bodies are to be rotated or axially positioned, the elongated bodies must be able to rotate freely with respect to the adjacent body or bodies they are connected to. When a downhole tool is inserted within a deviated wellbore, gravity and other forces causes friction. Free rotation of the elongated bodies of a downhole tool is then hindered. If free rotation of the elongated bodies is hindered, they will not be able to be positioned into the desired orientation. Therefore, when the downhole tool consists of multiple perforating guns, perforations cannot be produced at the desired orientation along the wellbore.

When perforating guns, are used in slanted or deviated wellbores it is often important that the tool be in a specific radial orientation. For example, orienting perforating guns in deviated wells enables the well operator to aim the shaped charges of the perforating gun at specific radial locations along the circumference of the wellbore. This is desired because the potential oil and gas producing zones of each specific well could exist at any radial position or region along the wellbore circumference. Based on the presence and location of these potential producing zones adjacent a deviated well, a well operator can discern a perforating gun orientation whose resulting perforations result in a maximum hydrocarbon production. Not only could a perforation aimed at the wrong angle not result in a preferred hydrocarbon production, but instead could produce unwanted sand production from the surrounding formation into the wellbore.

SUMMARY OF THE INVENTION

Disclosed herein is an example of a device for attachment to a downhole string. In one example the device is a roller system for use in a wellbore downhole that is made of a body having a substantially cylindrical outer surface and that is selectively engaged by a couple to the downhole tool. A bore is formed axially through the body that is adapted to receive a portion of a downhole string. Also include is a swivel in the couple so that the body rotates with respect to the downhole string. Rollers are mounted on opposing lateral sides of the body that are rotatable about an axis that intersects the housing and that have diameters greater than a height of the body, so that when the downhole string is disposed in the wellbore, the rollers are rotatable with respect to an axis of the downhole string. The body can include lateral sections that bolt together. The portion of the downhole string that extends through the bore can be a mandrel having opposing ends adapted for coupling within the downhole string. In this example, the mandrel is retained in substantially the same azimuthal position as the downhole string. The swivel can include bearings between the housing and mandrel and that are adjacent shoulders on the mandrel defined where the outer surface of the mandrel projects radially outward at location that are spaced axially apart and wherein a spindle is defined on the mandrel between the shoulders. The portion of the downhole string that extends through the bore can be a downhole tool. In an example, the rollers have a hemispherically shaped convex outer surface and a concave inner surface that is partially hollow and receives a portion of the body therein. Indentations may be included on an outer surface of the rollers for promoting traction between the rollers and an inner surface of a tubular in the wellbore. A portion of the convex outer surface of the rollers can have a contour approximate to a contour of an inner surface of a tubular in the wellbore to thereby define a contact length between the rollers and the tubular. In one example, the portion of the downhole string that extends through the bore is a perforating gun.

Also included herein is a downhole string that is selectively deployed in a tubular that is disposed in a wellbore. The downhole string is made up of a series of elongate members connected end to end with a swivel on an outer surface of a portion of one of the members. A housing is releasably coupled onto the swivel and is rotatable about an axis of the one of the members. Rollers are mounted onto lateral sides of the housing that have a diameter greater than a height of the housing, so that an outer circumference of the rollers is in contact with an inner surface of the tubular. One of the members can be a roller sub having opposing ends configured for coupling to other elongate members. In one example, the roller sub includes a mandrel having axially spaced apart shoulders defined where an outer surface of the mandrel extends radially outward and a spindle provided between the shoulders. Optionally, the swivel includes bearings between the housing and the spindle so the housing and rollers can rotate with respect to an axis of the roller sub. Optionally, the lateral sides of the housing are substantially planar and wherein the shoulders project past the lateral sides to define a recess in which the rollers are disposed. In an example embodiment, the one of the members is a downhole tool. Optionally, the rollers can have a hemispherically shaped convex outer surface and a concave inner surface that is partially hollow and receives a portion of the body therein. Indentations may be included on an outer surface of the rollers for promoting traction between the rollers and an inner surface of a tubular in the wellbore, and wherein a portion of the convex outer surface of the rollers has a contour approximate to a contour of an inner surface of a tubular in the wellbore to thereby define a contact length between the rollers and the tubular.

BRIEF DESCRIPTION OF THE SEVERAL VIEWS OF THE DRAWING

Some of the features and benefits of the present invention having been stated, others will become apparent as the description proceeds when taken in conjunction with the accompanying drawings, in which.

Figure 1:
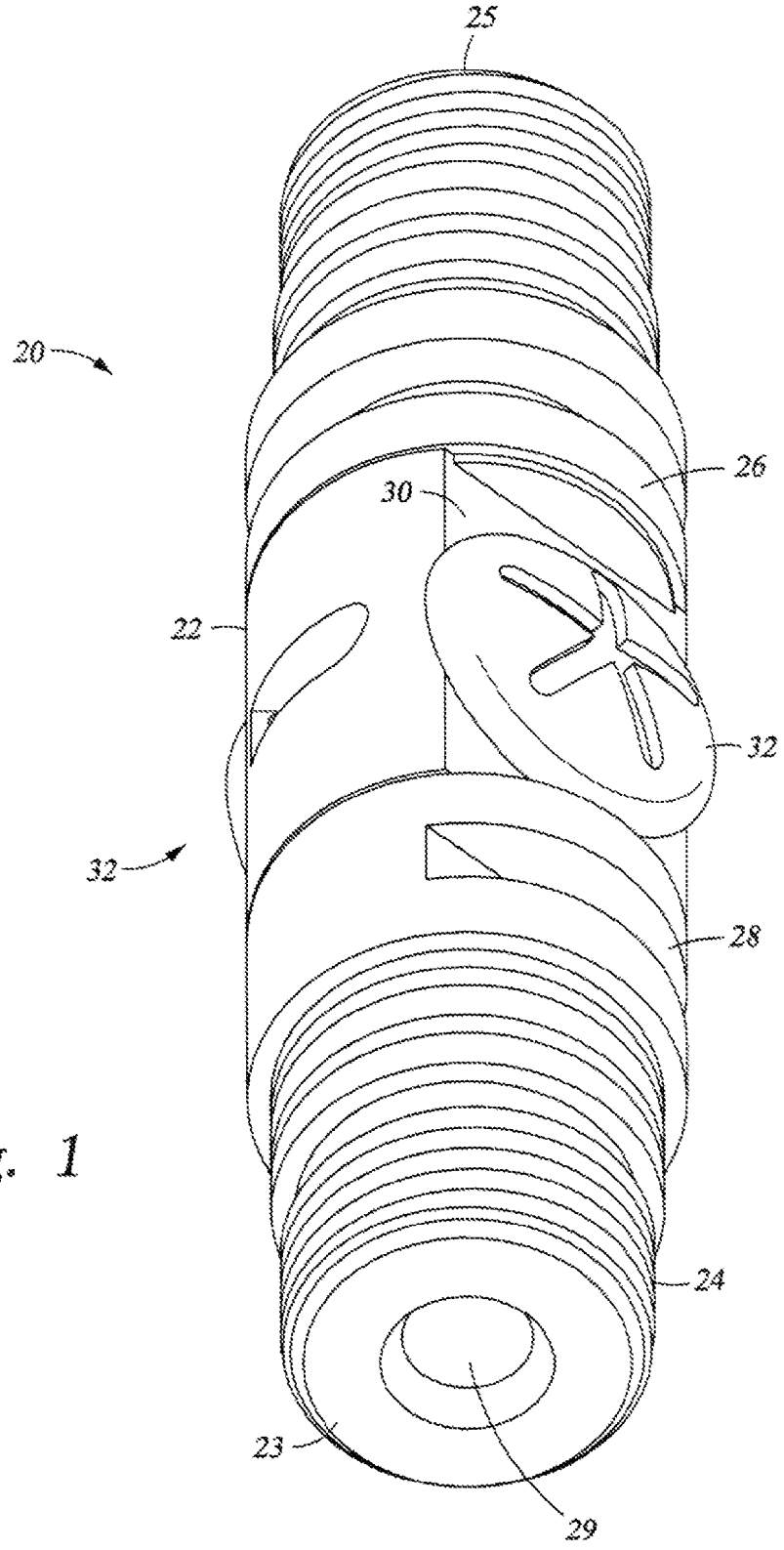
FIG. 1 is a side perspective view of an example embodiment of a roller assembly sub.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring now to FIG. 1, one example embodiment of a roller sub 20 is shown in a side perspective view. The roller sub 20 is made up of a body 22 and an elongate annular mandrel 23. The body 22 is mounted in a mid portion of the mandrel 23, which is a reduced diameter portion of the mandrel 23. Opposing ends 24, 25 of the mandrel 23 are shown having profiles for coupling within a downhole string (not shown). Wherein in an example the profiles are threaded fittings, that can be male or female. The outer radius of the mandrel 23 projects radially outward adjacent opposing ends of the body 22 to define shoulders 26 on the mandrel 23. A channel 27 is formed substantially along an entire circumference of one of the shoulders 26. A channel 28 in the other shoulder 26 is shown formed along a portion of its circumference. An axial bore 29 in the roller sub 20 extends the length of the mandrel 23. Recesses 30 are shown on lateral sides of the body 22 disposed at about a mid-portion of the body 22 and configured to receive rollers 32 therein. The recesses 30 have a substantially planar surface on the outer surface of the body 22 and terminate adjacent the shoulders 26. The outer surface of the body 22 between the recesses 30 is generally curved. The rollers 32 rotate about an axis $A_X$ shown intersecting the body 22.

Figure 2:
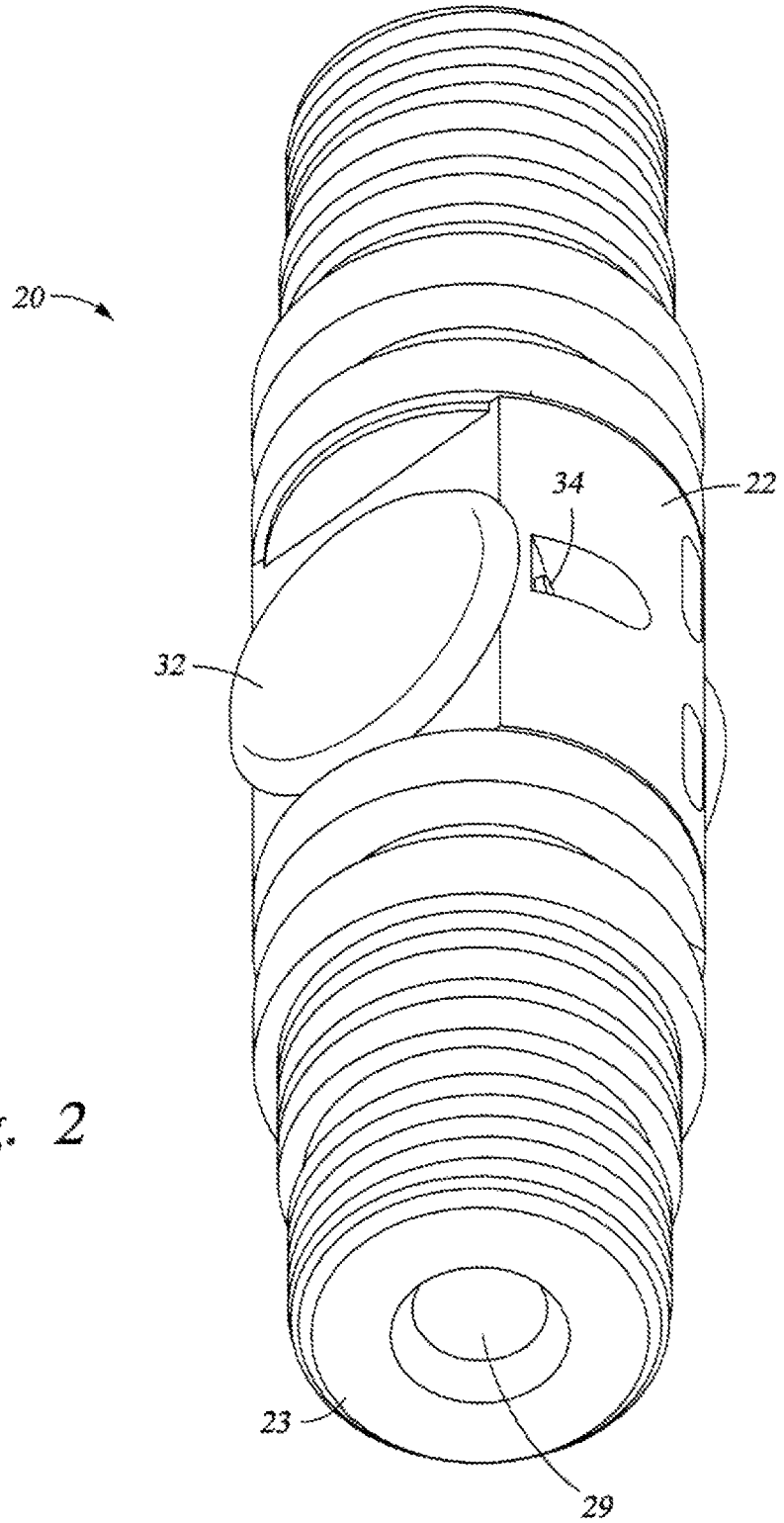
FIG. 2 is another side perspective view of the roller assembly sub of FIG. 1.

Referring now to FIG. 2, another side perspective view of the roller sub 20 is provided that illustrate fasteners 34 set in counter bores formed through the outer wall of the body 22 that depend downward from an upper surface of the body 22. In an example, the fasteners 34 are used for coupling together sections of the body 22 for mounting around the mandrel 23. In the embodiments of FIGS. 1 and 2, the rollers 32 are rotatingly mounted onto the body 22 for facilitating movement of the roller sub 20 within a tubular. The rollers 32 are disklike members having a generally planar surface facing the body 22 and a hemispherically shaped surface facing away from the body 22. The diameter of the rollers 32 of FIGS. 1 and 2 exceeds the height of the body 22, so that by positioning the axis of the rollers 32 at about the mid point of the height of the body 22, the outer radius of the rollers 32 extends past both the upper end lower surfaces of the body 22. In this example embodiment, the body 22 can be in more than a single orientation that allows the rollers 32 to engage an inner surface of a tubular in which the roller sub 20 is disposed.

Figure 3:
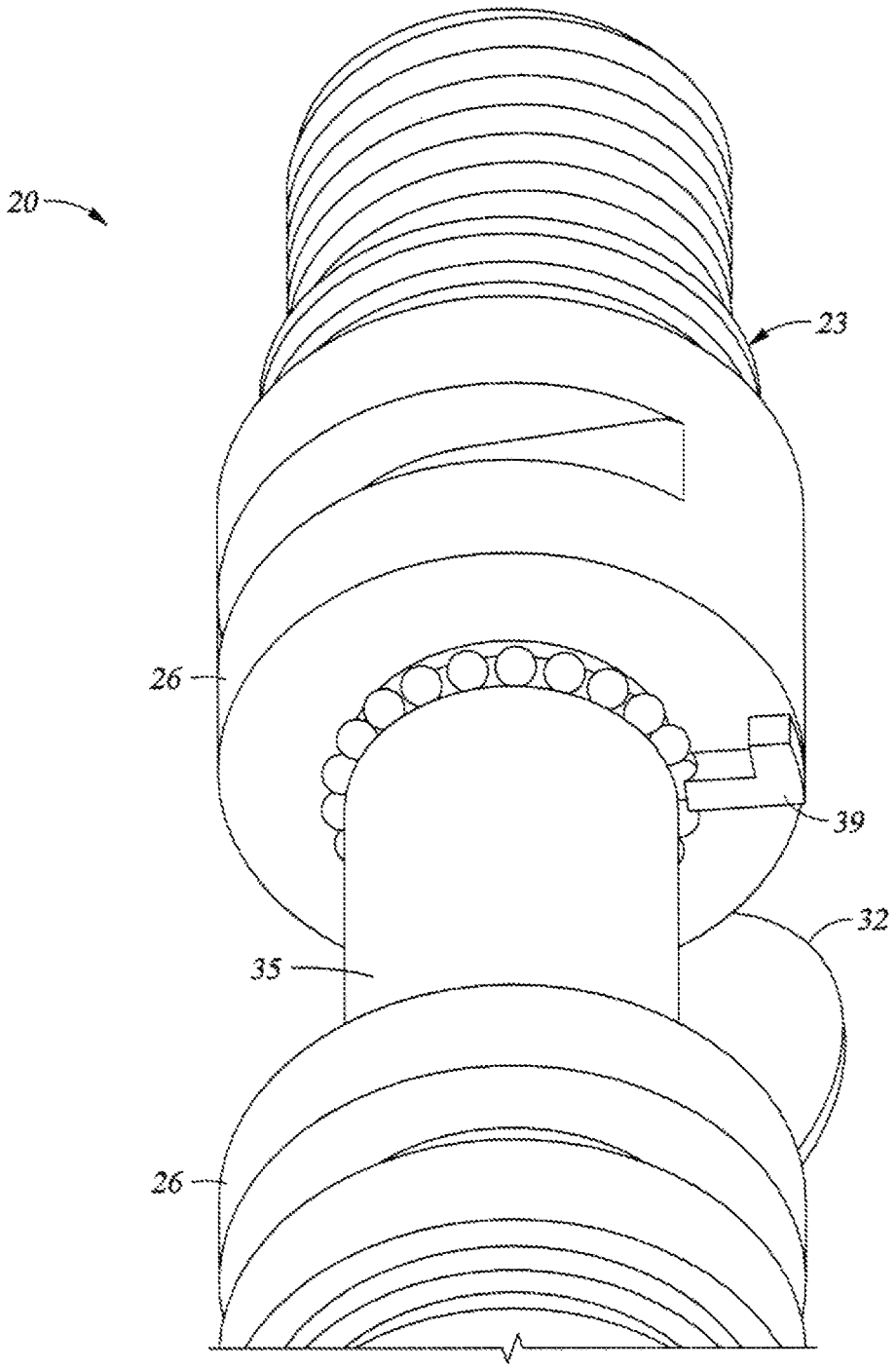
FIG. 3 is a side perspective partial sectional view of the roller assembly sub of FIG. 1.

Shown in FIG. 3 is a side perspective and partially exploded view of the roller sub 20 of FIGS. 1 and 2. In this example, the body 22 of FIGS. 1 and 2 is removed from the assembly 20 so the mid portion of the mandrel 23 is visible. As noted above, the mandrel 23 has a reduced diameter portion to define a spindle 35 over which the body 22 mounts. In the embodiment of FIG. 3 a multiplicity of spherical bearings 36 are shown set within a groove 37 that circumscribes the outer circumference of the spindle 35. The groove 37 and bearings 36 are shown at an end of the spindle 35. Although not shown in FIG. 3, another set of groove 37 and bearings 36 may be included at the opposite end of the spindle 35. Other embodiments exist wherein the groove 37 and bearings are formed at any axial distance along the length of the spindle 35.

Figure 4:
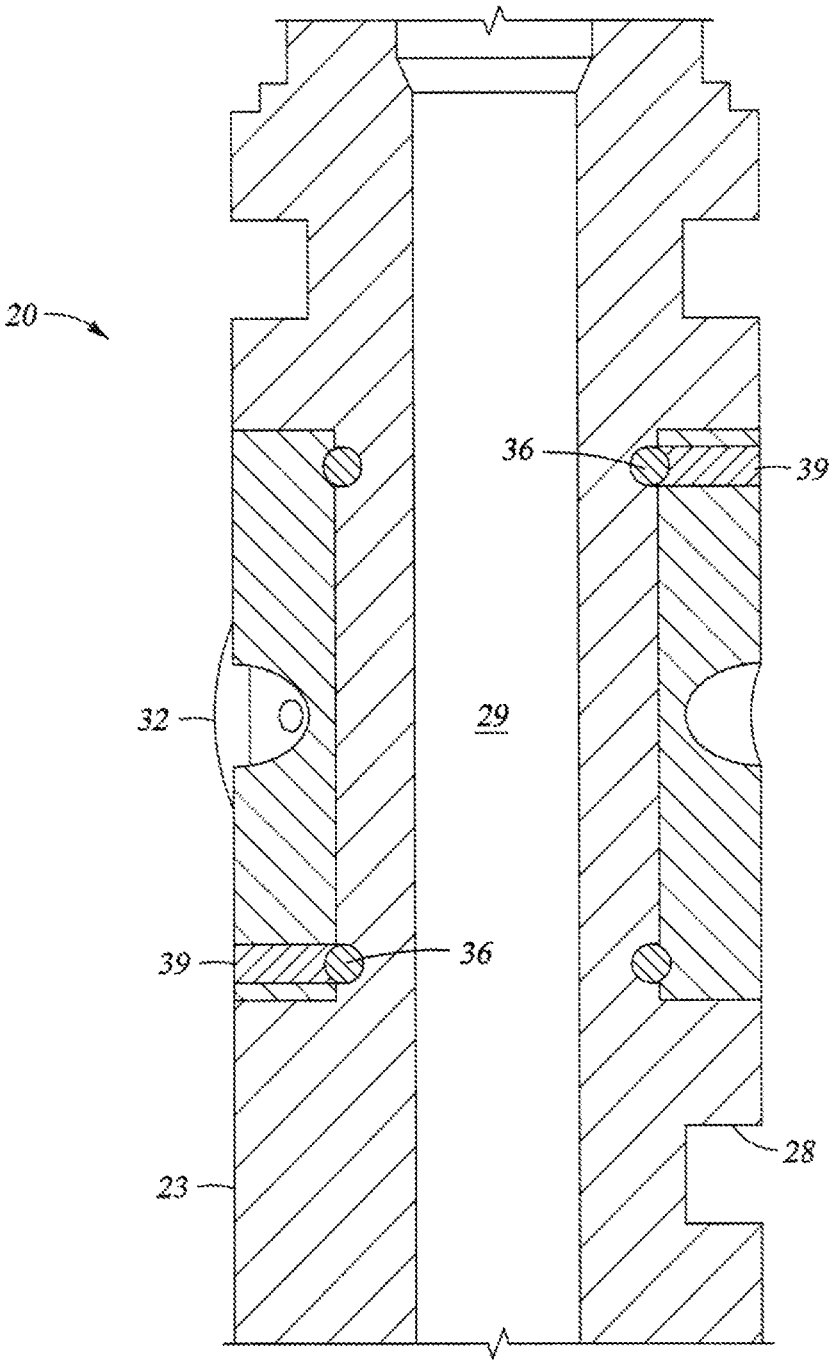
FIG. 4 is a side sectional view of the roller assembly sub of FIG. 3.

Referring now to FIG. 4, a side sectional view of the assembly 20 from FIG. 3 is provided. In the embodiment of FIG. 4, a pair of bearing assemblies made up of the bearings 36 set in grooves 37 are illustrated at distal locations on the spindle 35. The body segments 22 are shown set over the spindle 35 and in contact with the bearings 36. As will be described in more detail below, the roller sub 20 can be used in conjunction with any thing or device that is insertable within a subterranean well. The things used with the roller sub 20 can be passive or active; examples include a downhole string, downhole tools, completion strings, and any device used in wellbore operations. Also, a component of a tool or string can be used with the roller sub 20, such as a valve, a packer, a whipstock, a sleeve, and the like. An axle (not shown) couples the rollers 32 to the body 22 and is rotatable with respect to the body 22 so that the rollers 32 are freely rotatable as well with respect to the body 22. Thus, when set within a tubular within a well, or in an open hole configuration, the rolling action of the rollers 32 introduces less drag than does a downhole string sliding through the well. In an example embodiment, the body segments 22 are positioned on the mandrel 23, then the bearings 36 are fed into grooves via a slot at each end. A cover 39 is provided for retaining the bearings 36 within the body segments 22 after the bearings 36 are inserted therein. The cover 39 is a substantially solid L shaped member with an elongate portion that inserts into the slot. A lower end of the cover 39 is curved to accommodate the shape of the bearings 36.

Moreover, addition of the groove 37 and bearings in the sub 20 enables the body 22 to axially rotate with respect to the mandrel 23. As such, orientation of the mandrel 23 along with any associated or attached downhole string or string members experiences a substantially reduced resistance to turning. Thus when a downhole string is to be oriented, such as from an eccentric weight, the likelihood that the desired or selected orientation occurs is substantially increased.

Figure 5:
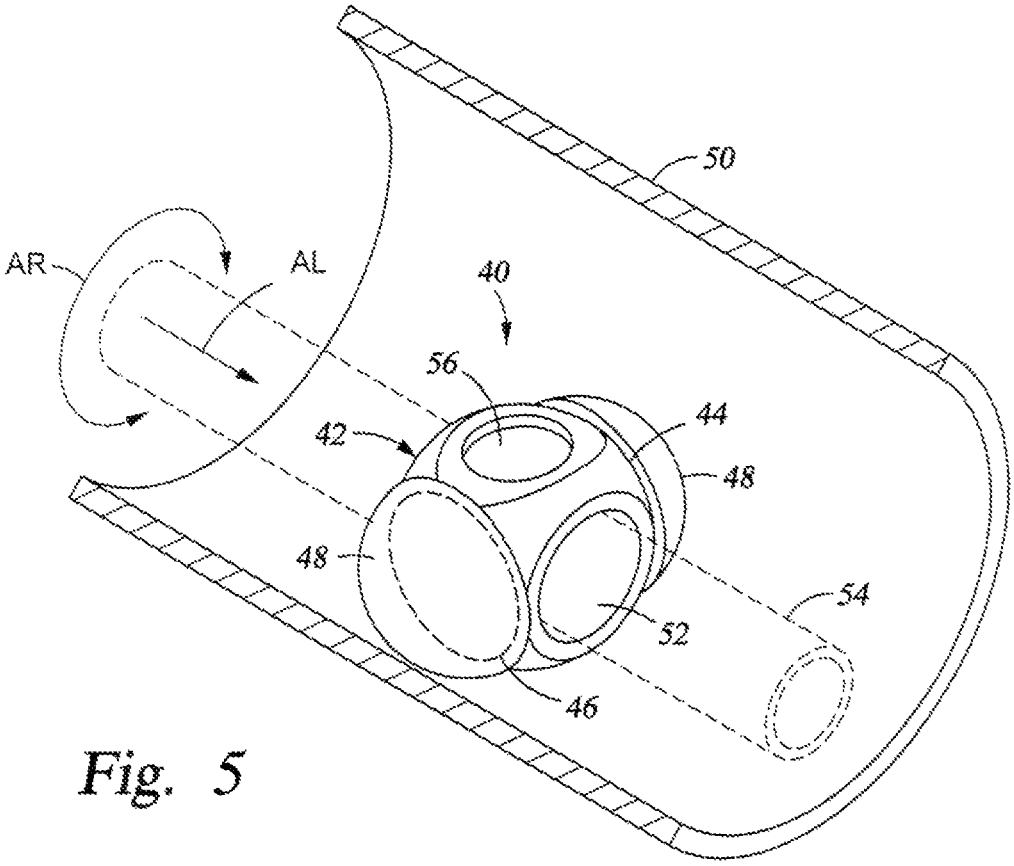
FIG. 5 is a side perspective view of a roller assembly in a tubular.

FIG. 5 illustrates an example of a roller assembly 40 that can be coupled with a downhole string or element of a downhole string. In the embodiment of FIG. 5, the roller assembly 40 includes a housing 42 made up of a pair of lateral segments 44, 46 that can be coupled to one another in a clam shell fashion for defining the housing 42. The lateral segments 44, 46 of FIG. 5 are bowl shaped members having a convex outer surface on one side and is concave and hollowed out on an opposite side. The concave sides of the lateral segments 44, 46 are facing one another with the convex sides facing radially outward. Each of the lateral segments 44, 46 is equipped with a hemispherical roller 48 on the convex outer surface of the lateral segments 44, 46, wherein the roller 48 is adapted to freely rotate with respect to either of the lateral segments 44, 46. The roller assembly 40 of FIG. 5 is shown set on a cut away of a tubular 50, wherein the tubular 50 can be a wellbore casing or a section of tubing. As discussed above, the addition of the rollers 48 enables movement of the roller assembly 40 along the axial length of the tubular 50 and substantially parallel with the direction of an axis $A_L$ of the tubular 50. The hollowed out concave sides of the lateral segments 44, 46 defines a bore 52 when the lateral segments 44, 46 are coupled as shown in FIG. 5. An example downhole device 54 (shown in dashed outline) projects through the bore 52, the downhole device 54 can rotate about axis $A_L$ of the tubular 50 as illustrated by arrow $A_R$. An optional opening 56 is shown extending through the housing 42.

Figure 6A:
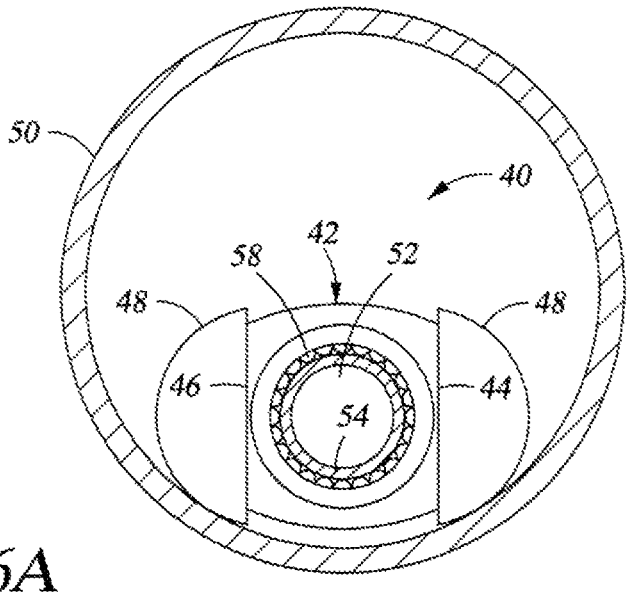
FIG. 6A is an end view of the roller assembly FIG. 5.

FIG. 6A provides a partial sectional end view of the roller assembly 40 of FIG. 5. In this embodiment, a multiplicity of bearings 58 are shown packed in a circumferential assembly within the housing 42 and across an inner periphery of each of the lateral segments 44, 46. The bearings 58 provide a frictional reduction for relative motion between the housing 42 and downhole string 54 coaxially set within the housing 42. Referring back to FIG. 5, the bearings 58 enhance movement along curved arrow $A_R$. The bearings 58 can be spherical as well as cylindrical roller bearings and can either be individually set within a recess provided on an inner circumference of the housing 42 or within respective inner and outer races (not shown).

Still referring to FIG. 6A, a side of the rollers 48 facing the lateral segments 44, 46 can be recessed in order to receive therein outer radial portions of the lateral segments 44, 46. The hemispherical outer surface of the rollers 48 is shown having a contour similar to the contour of the tubular 50 so that a larger contact length L and area can be realized between the rollers 48 and inner surface of the tubular 50. Moreover, spacing the rollers 48 apart a designated distance provides stability of the roller assembly 40 and reduces chances of tipping over in the tubular 50. Indentations 59 are optionally provided on the hemispherical surface of the rollers 48 that in one example can increase traction between the rollers 48 and tubular 50 and promote rotation of the rollers 48 when the roller assembly 40 moves through the tubular 50.

Figure 6B:
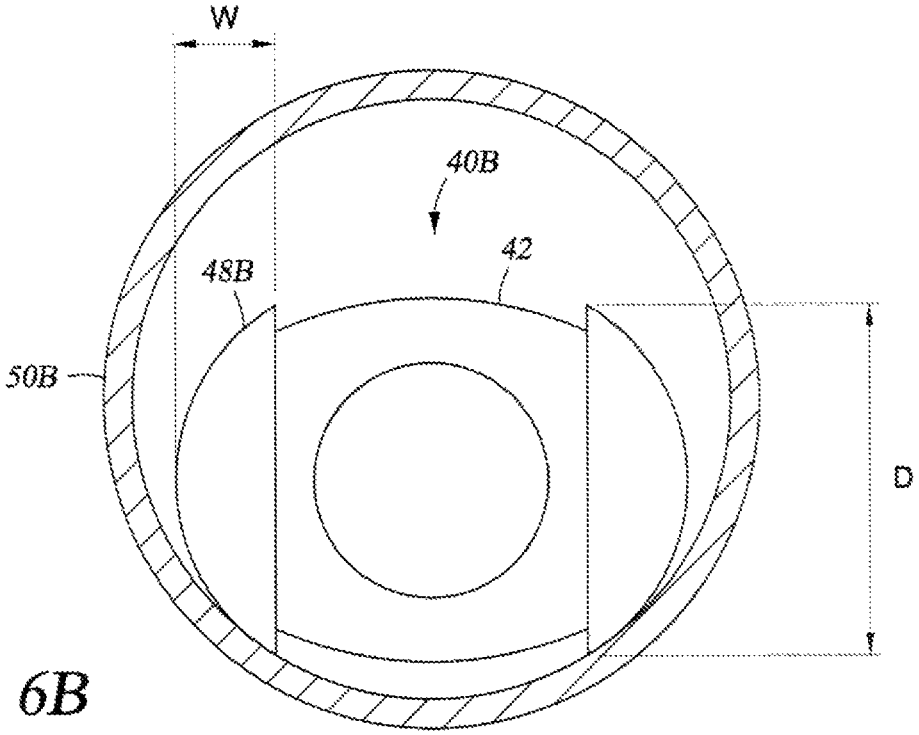
FIG. 6B is an end view of an alternate embodiment of the roller assembly of FIG. 6A.
Figure 6C:
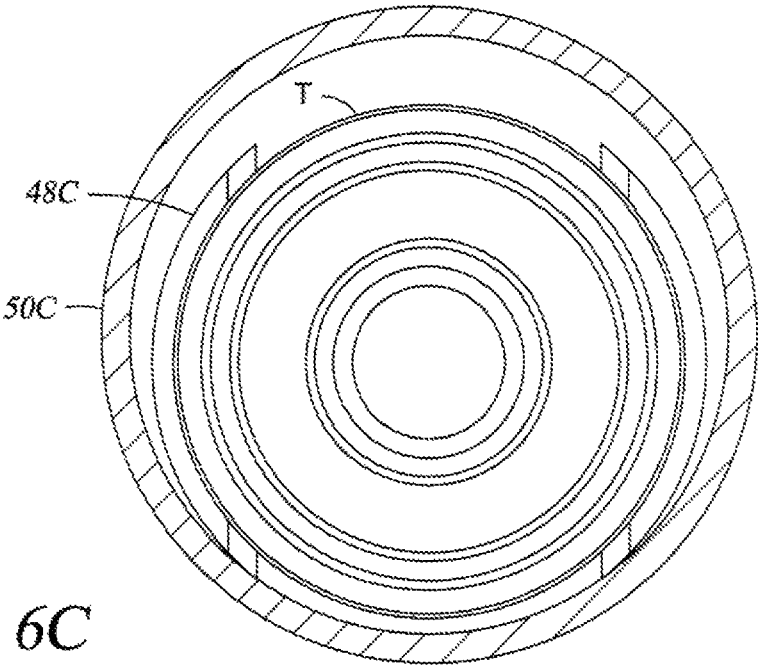
FIG. 6C is an end view of an alternate embodiment of the roller assembly of FIG. 6A.

FIG. 6B illustrates an alternate embodiment of a roller assembly 40B in an end partial sectional view. The tubular 508 of FIG. 6B has a diameter that is less than the diameter of the tubular 50 of FIG. 6A. As such, the width W and diameter D of the rollers 48B of FIG. 6B are respectively reduced over that of the width W and diameter D of the rollers 48 of FIG. 6A. Whereas the housing 42 of both roller assemblies 40, 40B may have substantially the same dimensions. Referring now to FIG. 6C, an example of a roller assembly 40C is shown in an end partial sectional view, where the roller assembly 40C is coupled with a downhole tool T and disposed within a tubular 50C. Here the tool T has an outer diameter of about 85% the inner diameter of the tubular SOC. In this example, the rollers 48C are dimensioned so that clearance is provided between the lower surface of the tool T and inner surface of the tubular 50C.

Figure 7:
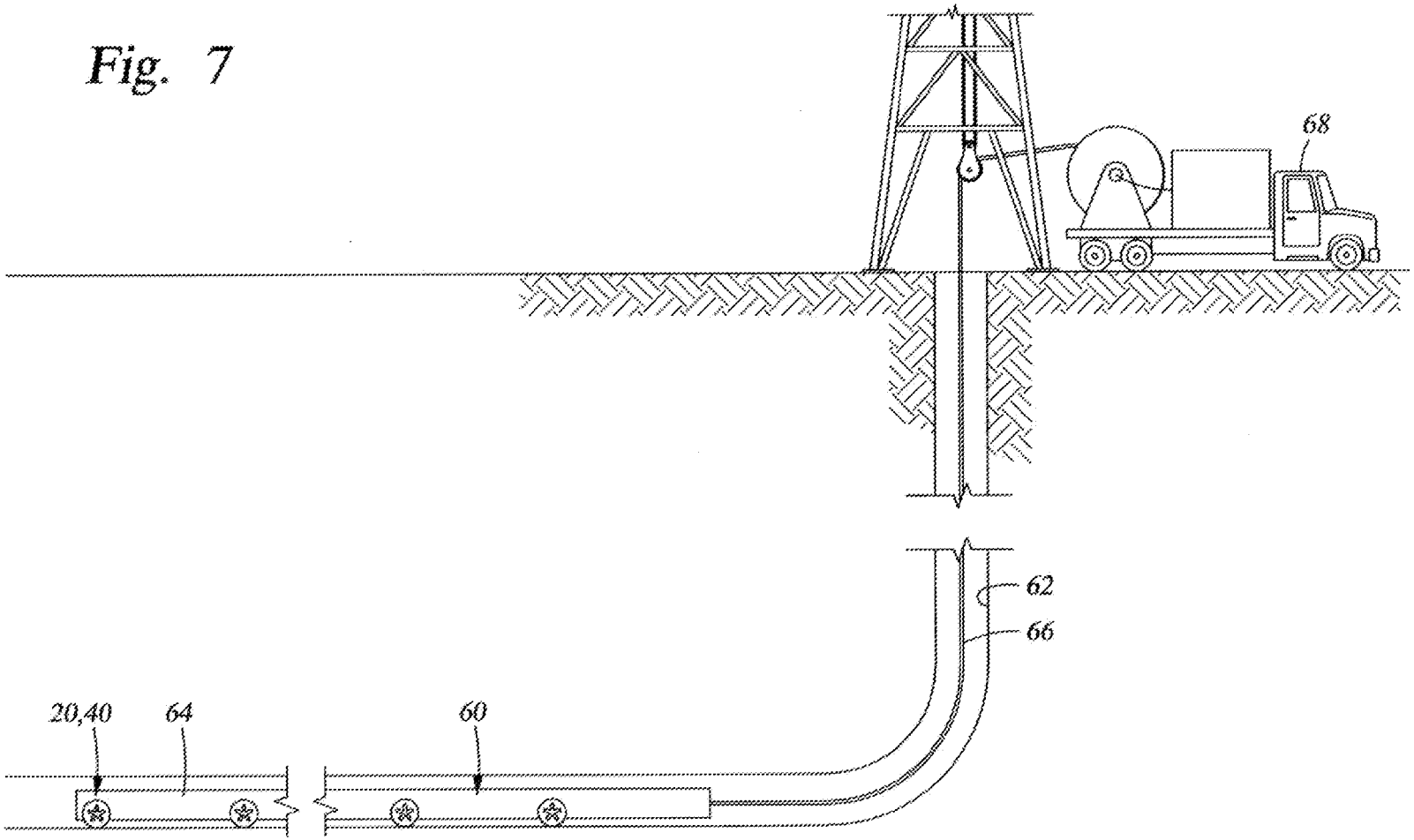
FIG. 7 is a side partial sectional view of a downhole string having a roller assembly.

FIG. 7 provides a partial side sectional view an example of a downhole string 60 set within a subterranean wellbore 62. In the example of FIG. 7, the downhole string 60 is made up of a number of individual string members 64 attached in series. Example members include perforating guns, sensors, acoustic devices, submersible pumps, and the like. A wireline 66 is shown suspending the string 60 within the well 62. A surface truck 68 is provided for manipulating and controlling the string 60 via the wireline 66. Alternatively, coiled tubing, drill pipe, or other elongate tubulars could be used for deploying the string 60 in the well 62. In the example of FIG. 7, roller subs 20 as well as roller assemblies 40 are shown either combined within the string 60 or coupled on an outer surface of the string 60 for facilitating movement throughout the well 62. In the embodiment of FIG. 7, the string 60 is optionally equipped with eccentric weights for strategically orienting one or more of the string members 64 within the string. Optionally, springs or motors (not shown) could be used for the step of orienting the string elements. An advantage of the device described herein is that because the reduced friction of axial movement of the string in a wellbore, longer perforating strings can be deployed and properly oriented that in the past. Moreover, as embodiments exist wherein the rollers 32, 48 respectively project past the outer surface of the body 22 and housing 42, bodies 22 and/or housings 42 in the string 60 can be azimuthally rotated with respect to other bodies 22 and/or housings 42 in the string 60 so that rolling engagement between the string 60 and tubular (not shown) in the well 62 can occur at any angular position about an axis of the string 60.

The improvements described herein, therefore, are well adapted to carry out the objects and attain the ends and advantages mentioned, as well as others inherent therein. While presently preferred embodiments have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A roller system for use in a wellbore with a downhole tool and comprising:

a mandrel retained in substantially the same azimuthal position as the downhole tool and comprising opposing ends that selectively couple to the downhole tool to define a portion of a downhole string, and a reduced diameter mid portion that defines a spindle, shoulders, and a recess between the shoulders;

an annular body that circumscribes the spindle and fits in the recess, the body comprises lateral sections that are fastened together and opposite ends that face shoulders;

bearings between the body and the spindle so that body rotates with respect to the mandrel and the downhole string; and rollers mounted on opposing lateral sides of the body that are rotatable about an axis that intersects the housing and that have diameters greater than a height of the body, so that when the downhole string is disposed in the wellbore, the rollers are rotatable with respect to the downhole string.

2. The roller system of claim 1, wherein the rollers have a hemispherically shaped convex outer surface and a concave inner surface that is partially hollow and receives a portion of the body therein.

3. The roller system of claim 2, wherein a portion of the convex outer surface of the rollers has a contour approximate to a contour of an inner surface of a tubular in the wellbore to thereby define a contact length between the rollers and the tubular.

4. The roller system of claim 1, wherein the downhole string comprises a perforating gun.

* * * * *